US009657553B2

(12) United States Patent
Ottestad

(10) Patent No.: US 9,657,553 B2
(45) Date of Patent: May 23, 2017

(54) INTERMEDIATE STORAGE

(75) Inventor: Nils Terje Ottestad, Husoysund (NO)

(73) Assignee: OBS Technology AS, Husoyund (NO)

( * ) Notice: Subject to any disclaimer, the term of this patent is extended or adjusted under 35 U.S.C. 154(b) by 420 days.

(21) Appl. No.: 14/372,686

(22) PCT Filed: Sep. 12, 2012

(86) PCT No.: PCT/IB2012/054729

§ 371 (c)(1),
(2), (4) Date: Nov. 14, 2014

(87) PCT Pub. No.: WO2013/110979

PCT Pub. Date: Aug. 1, 2013

(65) Prior Publication Data

US 2015/0068606 A1 Mar. 12, 2015

(30) Foreign Application Priority Data

Jan. 23, 2012 (NO) ..... 20120067

(51) Int. Cl.
*E21B 41/00* (2006.01)
*F04B 5/02* (2006.01)

(52) U.S. Cl.
CPC ..... *E21B 41/0007* (2013.01); *F04B 5/02* (2013.01); *Y10T 137/0318* (2015.04); *Y10T 137/85954* (2015.04); *Y10T 137/86002* (2015.04); *Y10T 137/86027* (2015.04)

(58) Field of Classification Search
CPC ..... E21B 41/0007
USPC ..... 60/418
See application file for complete search history.

(56) References Cited

U.S. PATENT DOCUMENTS 6,192,680 B1 * 2/2001 Brugman ..... E21B 33/0355 60/398
6,202,753 B1 * 3/2001 Baugh ..... E21B 33/0355 166/364
2005/0178557 A1 8/2005 Johansen et al.
(Continued)

FOREIGN PATENT DOCUMENTS

GB 2215408 9/1989
NO 331478 1/2012
WO 0112305 2/2001
(Continued)

OTHER PUBLICATIONS

International Search Report and Written Opinion for PCT/IB2012/054729 dated Nov. 23, 2013.
(Continued)

*Primary Examiner* — Thomas E Lazo
(74) *Attorney, Agent, or Firm* — Andrus Intellectual Property Law, LLP

(57) ABSTRACT

A subsea system is for uptake and supply of a liquid. The system comprises a storage tank having at least one outlet, a valve assembly, a pump having a high-pressure side and a low-pressure side, and a feed line. The outlet is in fluid communication with a lower internal volume of the tank, and the valve assembly. The low-pressure side of the pump and the feed line are in fluid communication with the outlet, and the valve assembly is arranged on the feed line, and the feed line is bypassing the pump, such that said pump may withdraw liquid from the tank when the valve assembly on the feed line is closed.

17 Claims, 10 Drawing Sheets

(56) References Cited

U.S. PATENT DOCUMENTS

Figure 1:
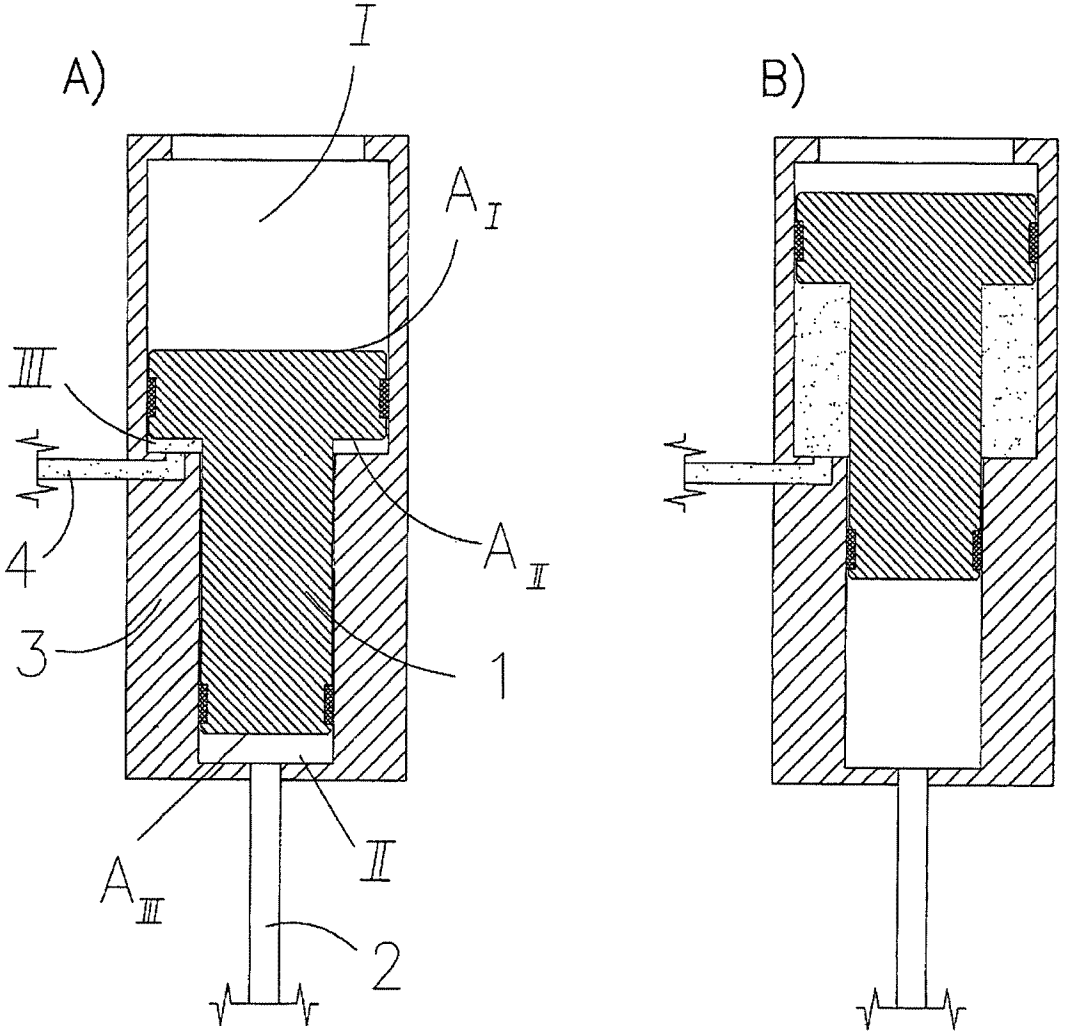

2006/0254763 A1 11/2006 Tips et al.

FOREIGN PATENT DOCUMENTS

| | | | | |
|---|---|---|---|---|
| WO | 2009045110 | | 4/2009 | |
| WO | WO 2009045110 | A1 * | 4/2009 | ..... E21B 33/0355 |
| WO | 2009132300 | | 10/2009 | |
| WO | 2010142612 | | 12/2010 | |

OTHER PUBLICATIONS

Response to Written Opinion for PCT/IB2012/054729 dated Feb. 28, 2014.
Written Opinion for PCT/IB2012/054729 dated Jun. 25, 2014, Oct. 31, 2016.

* cited by examiner

INTERMEDIATE STORAGE

CROSS-REFERENCE TO RELATED APPLICATIONS

This application is the U.S. national stage application of International Application PCT/IB2012/054729, filed Sep. 12, 2012, which international application was published on Aug. 1, 2013. as International Publication WO2013/10979 in the English language. The international application is incorporated herein by reference. in entirety. The international application claims priority to Norwegian Patent Application No. 20120067, which is incorporated herein by reference.

TECHNICAL FIELD OF THE INVENTION

The invention concerns a subsea system for intermediate storage of liquid to be received from or delivered to one ore more mechanical devices.

BACKGROUND

Some subsea operations require regularly liquid supply from the surface via umbilicals. At large depths long umbilicals are required, and replenishing of liquid goes slow. Liquid to be consumed is therefore usually stored on the seabed.

In various subsea operations there is a risk of improper opening or closing of valves, resulting in momentary pressure rise or pressure fall that may harm seals or other pressure sensitive components. In other situations influence of temperature on liquids inside confined spaces will make it necessary quickly to supply or remove liquid in a controlled manner in order to avoid harmful pressure variations.

Thus, there is a need for pressure stabilizing devices, preferably in the form of quick responding modulating valves that connect the area in question with a high pressure supply system or a low pressure receiving system.

In many situations it is desirable to reuse the liquid, which means that the systems must be able to return the liquid as required.

In most subsea installations electric power is available. Hence, it is appropriate to use electrically driven pumps. To reuse liquid that has been removed to prevent pressure build-up, the receiving system for that liquid must be able to receive and return it in a simple and reliable manner.

As the oil industry has been involved in larger sea depths, it has been increasingly important to find good solutions to these needs.

SUMMARY OF THE INVENTION

The present invention is based on a system for reception/storage and supply of liquid. The main element is a storage tank that in the normal situation is virtually without internal pressure, valves for regulation of liquid supply from mechanical devices to the storage tank, and one or more pumps that is adapted for pumping of the liquid from said storage tank to said mechanical devices or to intermediate accumulators.

The low, nearly non-existing, pressure in the storage tank is achieved by taking basis in a storage tank that is completely filled with liquid. The attached pump is then taking out liquid through an outlet/intake in the bottom part of the storage tank, and a very low pressure is obtained almost immediately. The amount of liquid that has been removed from the tank is representing the available storage capacity of the tank. Relevant mechanical devices include, inter alia, pressure equalization systems, actuators and power amplifiers.

The storage system is based on a simple operational principle that makes it easy to generate large forces, and move fairly large amounts of a liquid during a short time.

The invention also relates to methods of using the invention to generate power or hydraulic energy in a way that has substantial advantages compared to the use of known technology.

This system has features that provide many opportunities beyond solving the above types of problems related to pressure equalization. Some of these applications are shown in more details below.

The present invention is further described hereinafter and by the attached claims.

The present invention provides a subsea system for uptake and supply of a liquid from and to one or more mechanical devices, the system comprising a storage tank arranged for being filled with the liquid and having at least one outlet, the at least one outlet being in fluid communication with a lower internal volume of the storage tank, a valve assembly being arranged on a feed line, a pump having a high-pressure side and a low-pressure side, and a return line being connected to a high-pressure side of the pump, the valve assembly with the low-pressure side of the pump and the feed line being in fluid communication with the at least one outlet, wherein a closed, liquid-free volume is defined in an upper portion of the storage tank above the liquid volume surface of the storage tank, and the feed line is connected to the low-pressure side of the pump and to at least one of the at least one outlet such that the pump may withdraw liquid from the storage tank when the valve assembly on the feed line is closed, thereby reducing the pressure in the liquid-free volume to a level substantially below ambient liquid pressure, the opening of the valve assembly allowing liquid to flow from the mechanical device to the storage tank, wherein the mechanical device is subjected to a pressure difference between ambient water and the liquid-free volume and accordingly starts generating hydraulic power.

In a subsea system as described above, the at least one outlet can be in fluid communication with a lower internal volume of the storage tank via a tube, such as a vertical riser. If it is desired to have the at least one outlet located on the side of the storage tank, the tube can be angled to have it linked to the outlet.

In a subsea system as described above, the outlet can be arranged in a lower part of the storage tank, preferably near the bottom of the tank, thus to ensure that all liquid can be drawn out of the tank even when said liquid has virtually no pressure.

In a subsea system as described above, the pump may include an inlet on the low pressure side, and the inlet may be arranged below the outlet of the storage tank. In a subsea system as described above, the pump may be a "positive displacement" type pump, preferably comprising at least one reciprocating pump piston unit.

In a subsea system as described above, the low-pressure side of the pump can be in fluid communication with the supply line at a point between the storage tank and the valve assembly.

In a subsea system as described above, the valve assembly can be an open/shut-off valve, a back pressure regulator or any valve or combination of valves suitable for controlling fluid flow through the feed line.

In a subsea system as described above, the supply line can be in fluid communication with the hydraulic fluid in a hydraulic actuator, the barrier fluid in a subsea motor chamber, or in fluid communication with any fluid system that requires or have the benefits from the regulation of fluid pressure to said fluid system.

In a subsea system as described above, the return line can be in fluid communication with the high-pressure side of the pump.

In a subsea system as described above, the return line can be in fluid communication with the supply line at a point on the supply line, the point lies on the opposite side of the valve assembly in relation to the storage tank.

Included in the present invention is the use of a subsea system, as described above, to regulate the pressure of fluids in a subsea system, said fluids include hydraulic fluids, barrier fluids and any other oil- or water-based fluids.

In the application described above, subsea system, for example a production piping, a pump, such as a subsea "booster" pump, an actuator, a hydraulic pressure amplifier or a storage tank for fluids.

The present invention also provides a method for achieving a subsea system capable of rapid absorption of a liquid, wherein the method comprises the steps of:

- filling a storage tank which has at least one outlet, with a liquid;
- arranging the storage tank with the at least one outlet in fluid communication with a lower internal volume of the storage tank;
- defining a closed, liquid-free volume in the upper portion of the storage tank above the liquid volume surface of the storage tank;
- interconnecting the storage tank and an external volume in need of supply of the liquid;
- supplying the external volume with liquid by withdrawing at least some of the liquid from the storage tank using a "positive displacement" pump in fluid communication with the outlet, thereby reducing the pressure in the liquid-free volume to a level substantially below ambient liquid pressure; and
- in case of undesirable pressure rise in the external volume, refilling the storage tank through a feed line by opening a valve assembly arranged on the feed line.

The term "fluid communication" is meant to describe the type of link between two objects, i.e. that a fluid can pass unhindered between the two objects in a controlled manner, such as through a pipe.

The term "a lower internal volume of the storage tank" is intended to include the volume of the storage tank located in the lower half of the storage tank, preferably in the lower quarter or tenth.

SHORT DESCRIPTION OF THE DRAWINGS

Figure 2B:
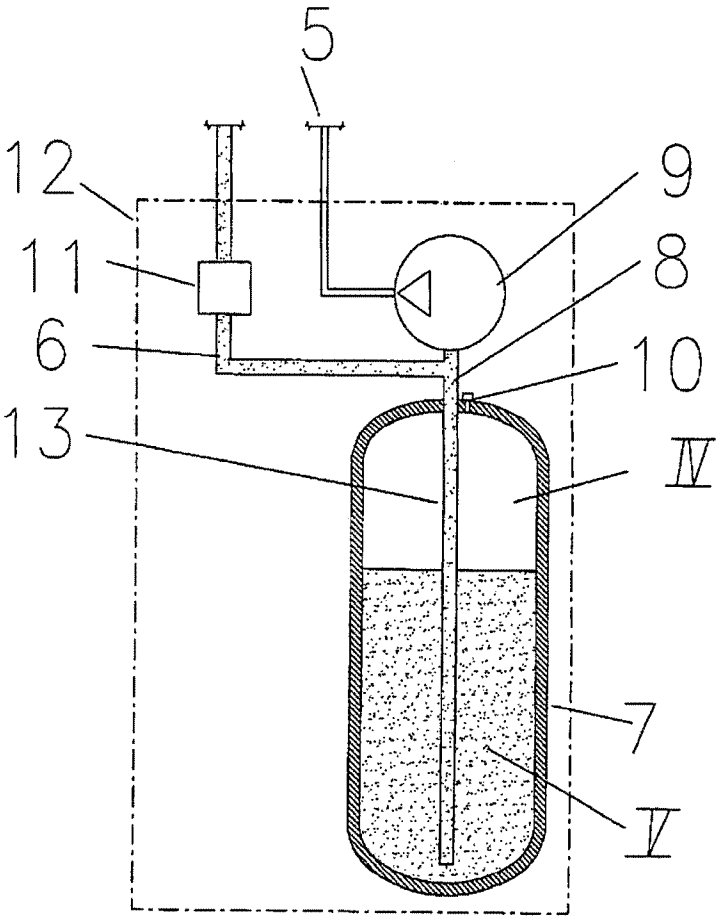
Figure 2A:
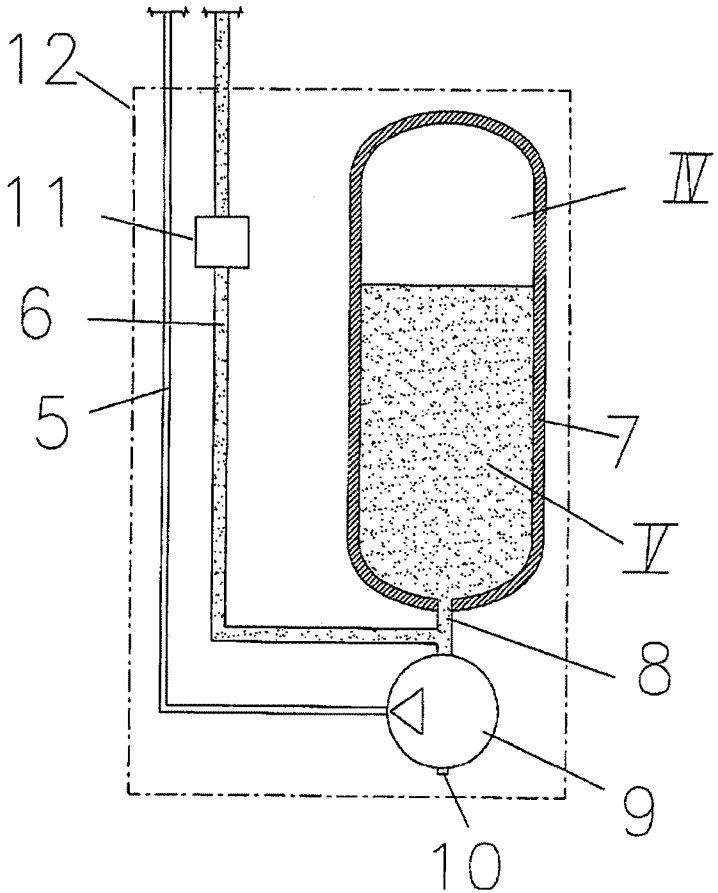
Figure 3:
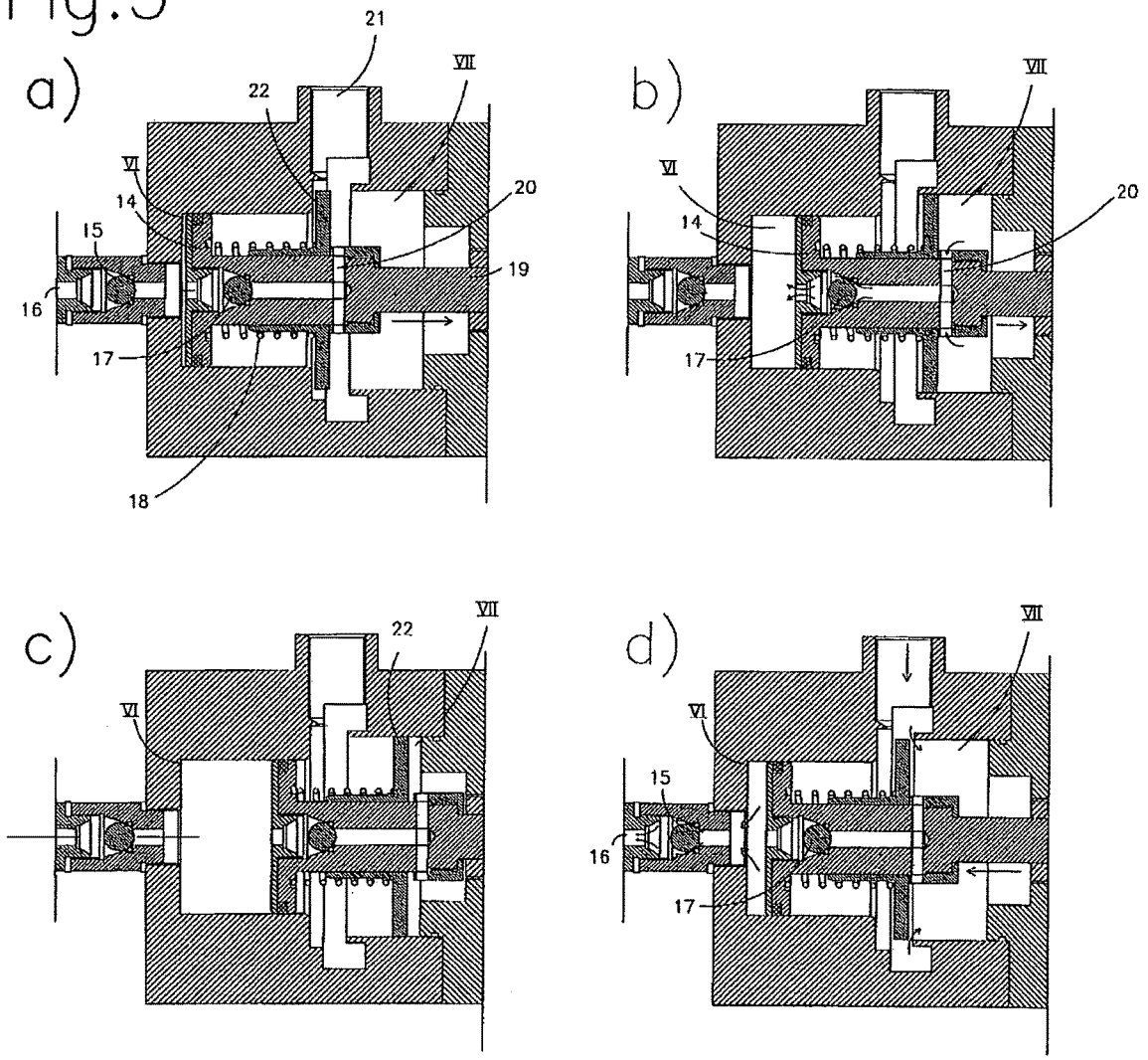

The invention is described with reference to FIGS. 1-10 with:

FIG. 1 showing a relevant concept for establishing a chamber with low pressure, FIG. 2 showing a schematic diagram of a system according to the invention, FIG. 3 showing a relevant functioning of a pump according to the invention.

Figure 4:
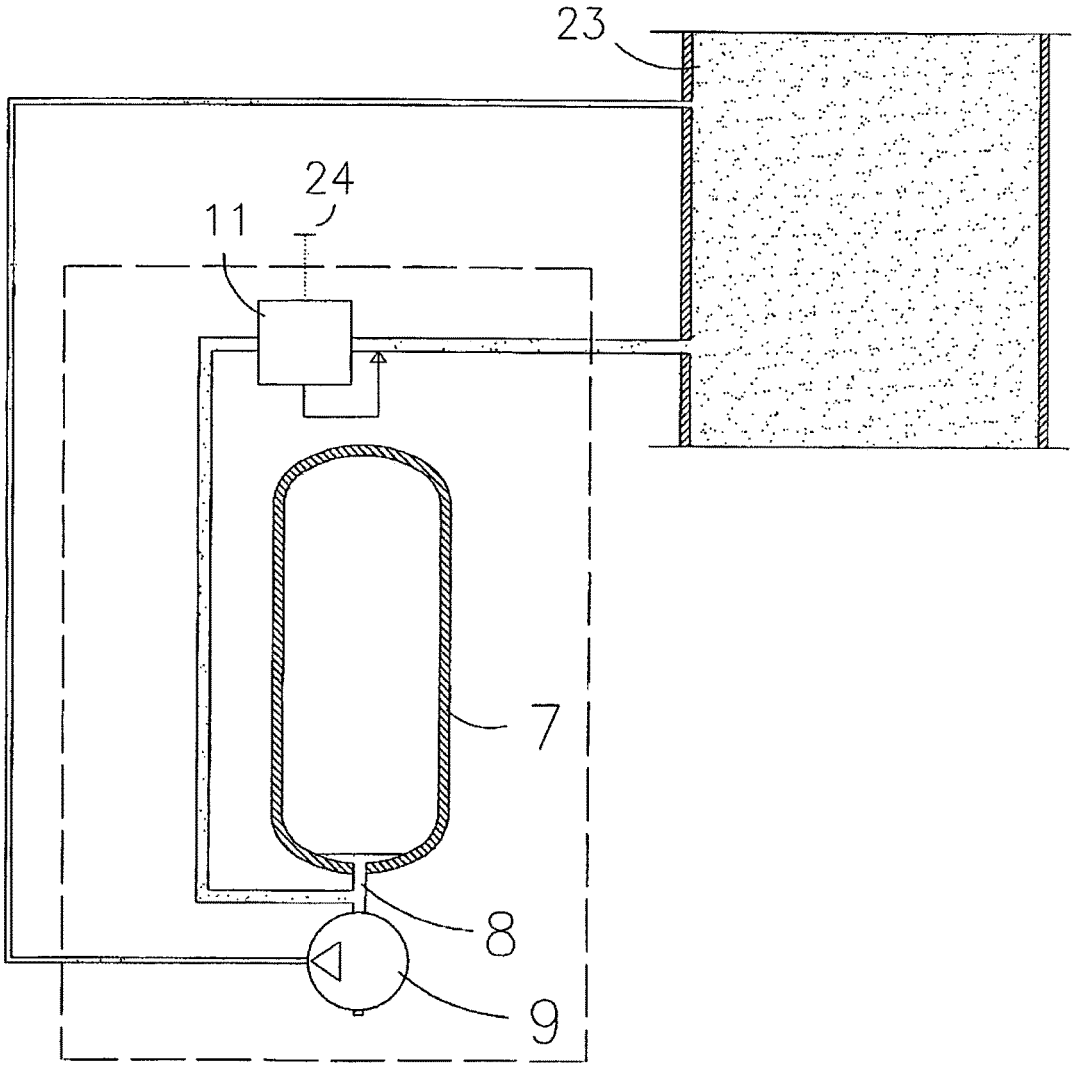
Figure 5:
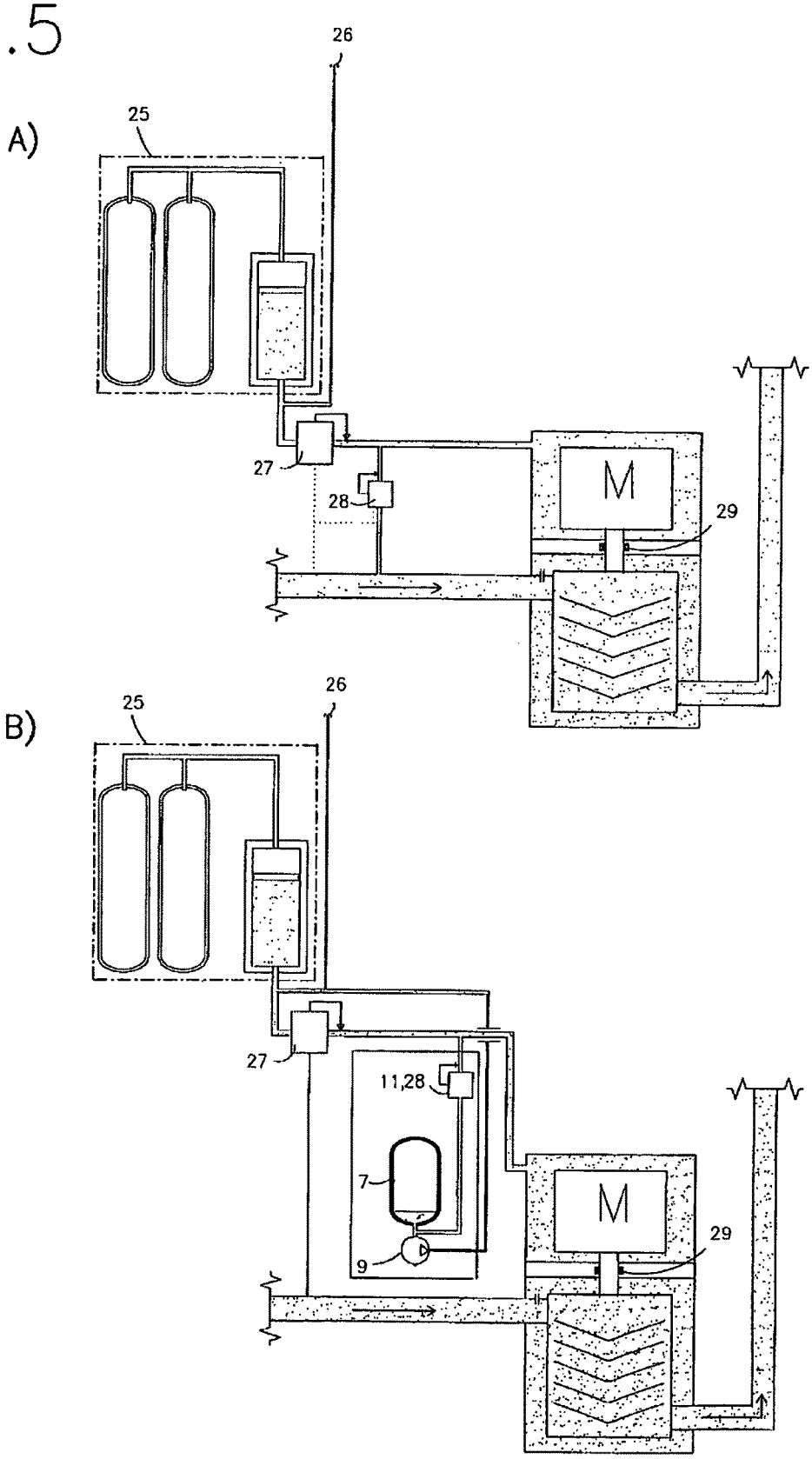
Figure 6:
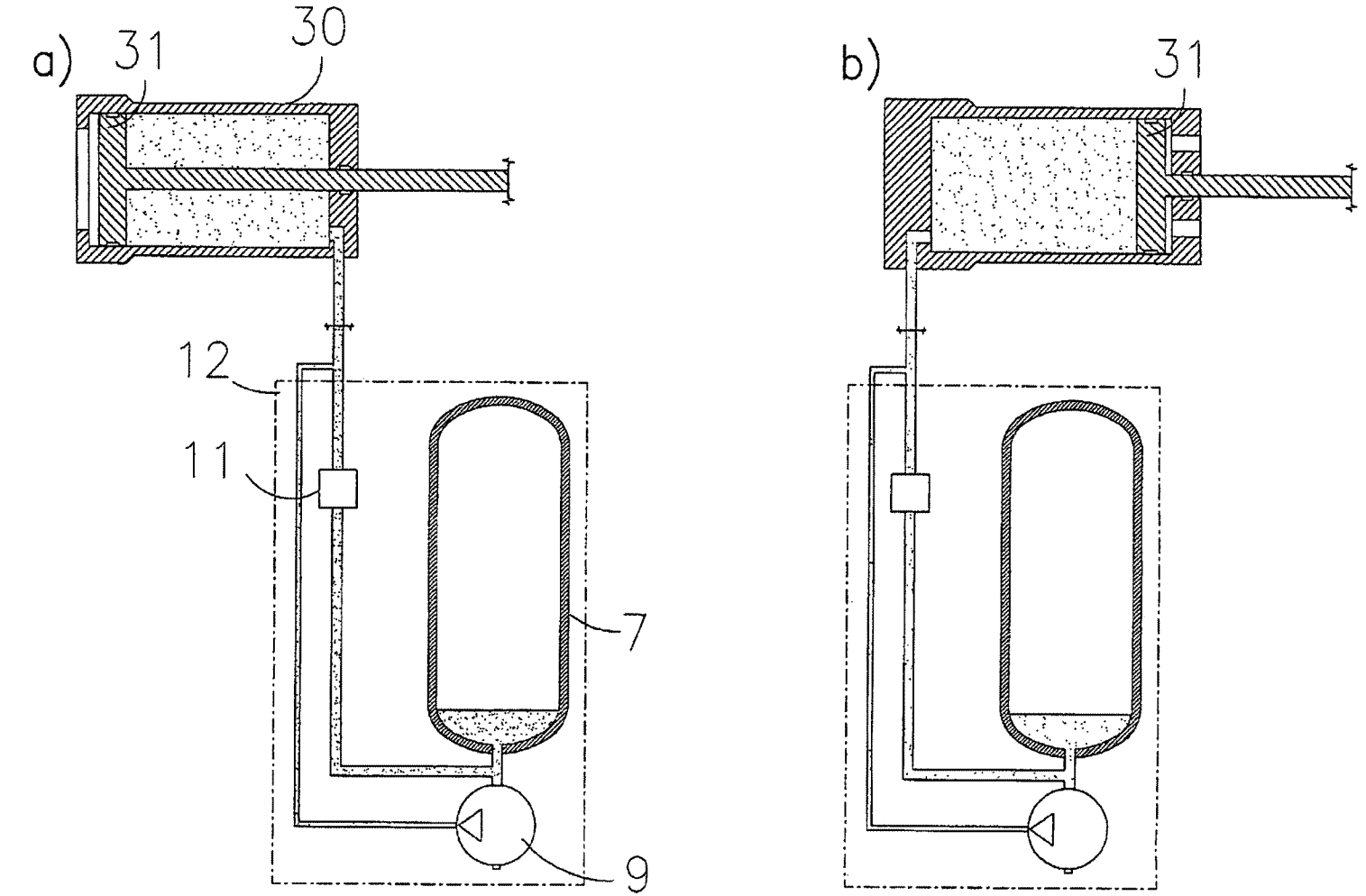
Figure 7:
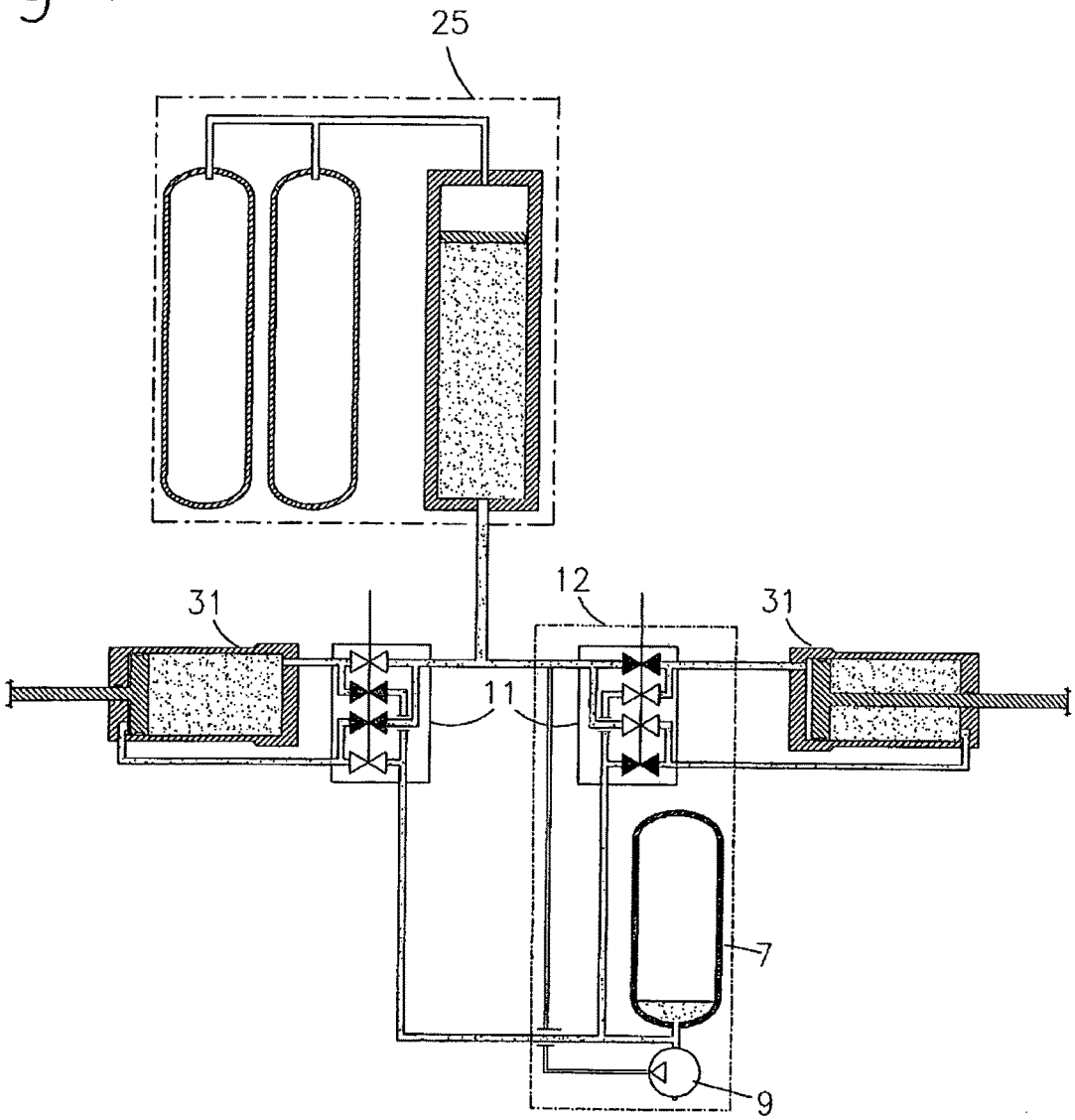
Figure 8:
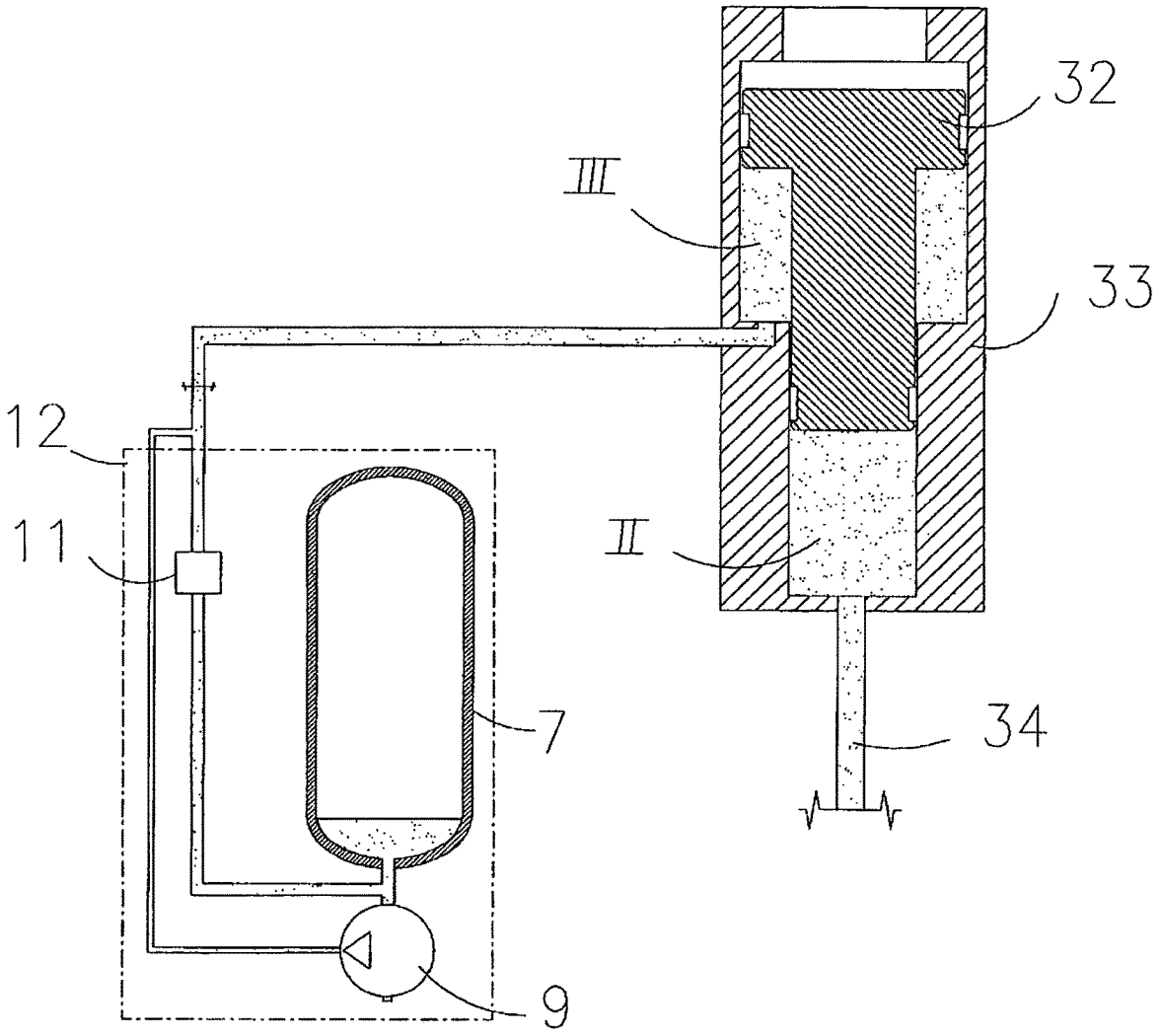
Figure 9:
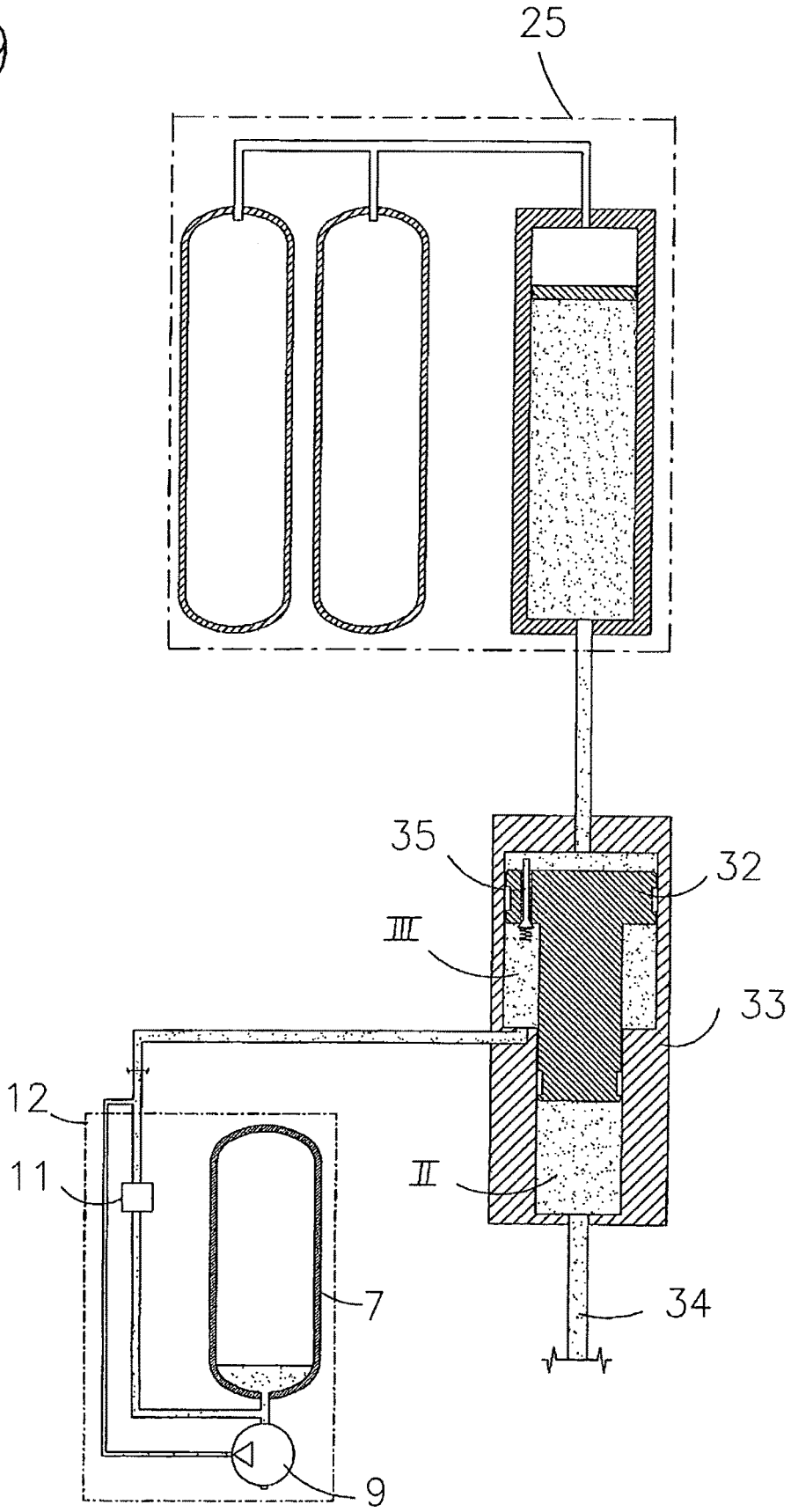
Figure 10:
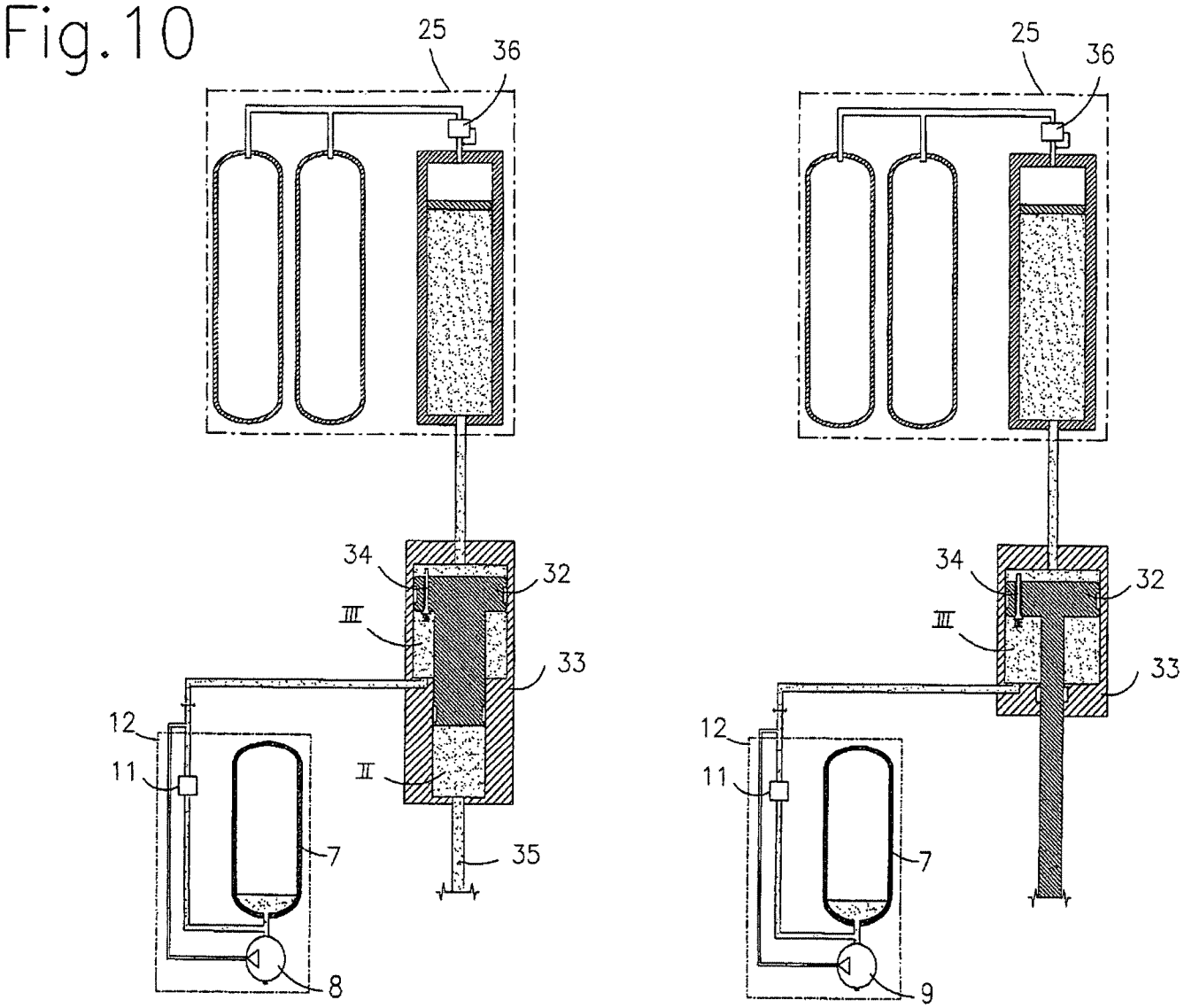

FIG. 4 showing a pressure stabilization system according to the invention,

FIG. 5 showing a recovery system for barrier fluid according to the invention, FIG. 6 showing an actuator system according to the invention FIG. 7 showing a double-acting actuator system according to the invention FIG. 8 showing a system for increase of a hydraulic pressure based on the ambient pressure and a system according to the invention, FIG. 9 shows a pressure boosting system similar to that shown in FIG. 8, connected to a device for supplying high pressure fluid, FIG. 10 showing a further improved version of a system as shown in FIG. 9.

DETAILED DESCRIPTION OF THE DRAWINGS

A relevant solution for achieving pressure equalization might be to establish a chamber with a flexible contact surface to the surrounding water. In principle, this can often be an appropriate solution since fluid must be delivered from subsea systems that often have a higher pressure than the surrounding water. Liquid that is dumped to such a chamber can optionally be reused by having it pumped back to the system in a controlled manner. An alternative solution might be to use compressed gas to generate low pressure in an expandable storage chamber. One such concept is outlined in FIG. 1. Chamber 1 on piston upper side, is open to the surrounding sea, and chamber II on piston lower side is in contact with a compressed gas. We ignore friction on sealing rings. The relationship between the pressures in the respective chambers I, II, III is then determined by the formula;

$$P_I*A_I=P_{II}*A_{II}+P_{III}*A_{III}$$

We take as an example; =AII=AIII=AI/2

Ambient pressure (PI)=100 bara (about 10(00 meters)

The gas pressure (PII)=150 bara

When these values are inserted in the formula we find; PIII=50 bara. le the storage chamber obtains a pressure that is 50 bar below ambient pressure. This would ensure that the chamber I, for most purposes, will absorb liquids sufficiently fast. The disadvantages of such a solution would be that the storage capacity, represented by the volume of chamber II, will be small compared to the size of the pressure equalization arrangement. Hence, a large capacity may require a disproportionate size on the subsea installation. The system of the invention, described below, provides an excellent solution to the needs described above, without the disadvantages of the system shown in FIG. 1.

Two embodiments of a system for storing and supplying liquid according to the present invention are shown in FIGS. 2A and 2B. The preferred embodiment is shown in FIG. 2A. The main element is a storage tank 7, a hydraulically or electrically operated pump 9 which is arranged to pump out fluid from the storage tank, and a valve assembly 11 which controls fluid supply to the storage tank.

Units 7, 9, 11 are interconnected by a pipe or hose system as shown in FIG. 2A. External components such as actuators, pressure equalization systems and similar are connected via a return line 5 and a feed line 6, these lines (pipes/hoses or similar) will in certain applications be connected.

Storage tank 7 should contain the least possible amount of vapor and gas. The amount of vapor and gas in the tank 7 can be minimized by initially having the tank 7 oriented with an outlet 8 oriented upward (as shown in FIG. 2B), then refilled with liquid V via a venting channel 10 which is preferably arranged in the pump 9. The venting channel 10 is then being closed, and the storage tank 7 is turned around so that the outlet 8 is at the lowest point (see FIG. 2A). When the pump 9 starts, the liquid V that is being removed, will lead to the formation of a liquid-free volume IV in the upper part of the storage tank 7. This volume contains vapor and any gas released from the liquid V when the pressure drops, but said vapor/gas will have little effect on the tank pressure. Just a small amount of liquid V has to be removed from the tank 7 before the resulting pressure is a fraction of 1 bara, and for practical purposes the storage tank 7 is then without pressure. The liquid-free volume IV represents the capacity of the storage tank 7, and the storage tank 7 can be completely emptied so that it may receive a volume of liquid corresponding interior chamber volume.

A pumping device that shall be able to remove liquid from a virtually pressure free storage tank can not be constructed as a conventional suction pump. "Positive displacement" pumps are suitable for this. Such a pump arrangement is preferably based on one or more reciprocating piston units, wherein the displacement of each piston unit along one displacement direction is used to limit a liquid flow from the storage tank, and to push the majority of this into an expanding pump chamber. Similarly, the opposing displacement of the piston is used to squeeze the pump chamber together, and thereby squeeze fluid out of the pump arrangement.

In the embodiment shown in FIG. 2A, the pump 9 is located below the bottom of the storage tank 7. If there is a near vacuum in the storage tank, gravity will ensure the supply of fluid to the suction side of the pump (low pressure side), and there must be used a type of displacement pump to pump out the liquid. The intake to the pump low pressure side must therefore be below the outlet of the storage tank 7 when the liquid free volume IV is virtually also pressure free.

In the embodiment shown in FIG. 2B, the pump is disposed above the storage tank 7, and connected to the lower part of the storage tank 7 through a riser 13. Now it is required to have a certain internal pressure to be able to pump liquid from the storage tank. One of many possible methods to achieve this is to use a liquid-free storage tank containing gas at for example 1 bar. After installation, a certain quantity of liquid can be supplied to the storage tank 7 since the gas in the tank 7, in principle, can be compressed until the vapor/gas pressure is equivalent to the pressure of the injected fluid. As an example, it is assumed that the storage tank 7 has fluid supply until 90% of its internal volume is filled with liquid V. This will cause the internal pressure rises to 10 bara—which in many contexts would be of no practical importance for the storage tank function.

The functional principle of a pump, suitable for use as pump 9 in a system according to the present invention, is described with reference to FIG. 3. This figure shows a pump arrangement with a piston unit 14 in four different positions. It is assumed here that the storage tank is approximately gas-free, i.e. that the liquid-free volume IV shown in FIG. 2A is virtually pressure free.

The movement of the piston unit is preferably provided by having the piston rod 19 connected to a reciprocating actuator that is driven by hydraulic power from a not shown hydraulic pump in combination with a direction controlling valve. This is considered as prior art, and are not described further.

Position a) shows the piston unit 14 in the left end position when the offset to the right is starting up. In this situation, the pump chamber VI has its smallest volume. The pump arrangement is filled with fluid via a channel 21 which is connected to the storage tank outlet 8. Position b) illustrates that the piston unit has come quite far to the right, and the spring-loaded piston 22 is now limiting chamber VII. The piston units 14 movement to the right causes reduction in chamber VII volume, whilst chamber VI volume is being increased Thus the pump chamber VI becomes filled with fluid via channel 20 and the check valve 17. This liquid filling will not start until the piston unit has moved so far to the right that the chamber VII is bounded by the piston 22. Liquid volume bounded in chamber VII is greater than the volume of the pump chamber VI, which therefore will be completely filled up.

Position c) shows the piston unit 14 at the right end position. Chamber VI is filled with liquid and can not absorb all of the liquid that was captured by the chamber VII. The remaining amount of liquid in chamber VII has prevented the piston 22 from following the last part of the rightward movement of the piston unit 14. Accordingly, the spring 18 becomes slightly compressed.

Position d) shows the situation after the piston unit 14 has completed the bulk of his left-directed movement that pumps the fluid through the check valve 15 and through the outlet 16. In the illustrated position, chamber VII is again been opened up, so that more liquid flows into it. Piston unit 14 is moved further towards left end position, and the duty cycle is then repeated.

Gravity ensures that the remaining liquid always fill up the low-lying portion of the storage tank. The upper part will contain only vapor and little gas, and the pressure in the storage tank will fall to the fraction of 1 bara as soon as the pump 9 has removed some fluid. The pump arrangement described here is able to pump all the liquid from the storage chamber. The storage tank 7 can thus be emptied so that it is ready to absorb an amount of liquid on the size of the tank total interior volume.

It would be easy to ensure that the storage tank capacity is maintained. Normally there is no possibility of gas intrusion, which otherwise could reduce the storage capacity. Any intrusion of fluid can be detected by level gauges arranged in the storage tank.

The valve assembly 11 is in the simplest version a remote open/shut-off valve, but this will vary according to the actual application of the invention.

The following description will focus on four key uses of the invention:

Elimination of harmful pressure buildup
Intermediate storage of barrier fluid
Operation of actuators, or
Production hydraulic energy In addition to this application, the system of the invention could be used in any context where it is required to remove and later on reuse liquid in subsea installations.

FIG. 4 shows a schematic diagram of how a system according to the invention can be coupled with a volume 23 to prevent the occurrence of dangerous pressure build-up due to e.g. errors in operation of an open/shut-off valve. In this application, the valve assembly 11 is preferably a type of back pressure regulator. This means that it will be adapted to open up precisely as required to prevent upstream pressure—the pressure in volume 23—from exceeding a given value. The opening pressure is related to a reference pressure provided via line 24. Since the storage tank 7 is practically pressure-free, it will be possible to dimension the valve assembly 11 and the associated lines so that there is in the principle always possible to prevent a harmful pressure build-up.

The same storage tank 7 can be utilized for securing multiple volumes, each volume then preferably being connected to a separate valve assembly 11. It is also possible to connect several pump arrangements to the same tank 7, and to pump received fluid to any desired destination.

Another important application of the invention has been to provide a system for intermediate storage and reuse of the barrier fluid in electric high-power equipment—such as subsea booster pumps, see FIG. 5. Barrier liquid is kept at a certain overpressure in the engine compartment etc. to prevent ingress of harmful fluids or particles through the rotating seals. After starting of the equipment, the temperature will increase relatively substantial, and it may be necessary to remove fluid volumes of approximately 25 to 40 liters in order to prevent unwanted pressure build-up.

In the following, subsea booster pumps will be used for simple exemplification. It is today normal to dump the barrier fluid from these pumps into the well stream—preferably via the pump module. Upon stopping of the pump, the engine compartment is quickly cooled down. This means that the barrier fluid in quantities of up to 40 liters must be supplied relatively quickly to prevent a dangerous pressure drop in the motor chamber. Up to now the compensation of this fluid is preferably provided by means of accumulators, which are supplied with fluid under pressure via an umbilical from the surface. At great depths the umbilical is very long, and a replenishment of the above mentioned quantities can take up to one day. Because there is always a risk of accidental stop of the pump, the liquid accumulators must at all times contain sufficient amount of liquid to compensate for at least one stop. it may take a long time before it is relevant to restart the pump if a couple of accidental breakdown occurs within a relatively short period.

There is a continuous consumption of barrier fluid because the rotary seals have a certain leakage. This leakage is normal in size from 1 to 2 liters per day. Significant cost reductions and time savings can be achieved by focusing on reuse of barrier fluid that had to be removed, so that umbilical can be dimensioned to compensate only for consumption.

FIG. 5A shows a typical system for maintaining a barrier pressure on a set level in relation to a reference pressure, which is normally equal to the pressure on the other side of the adjacent rotary seal. It is required a HP liquid supply unit 25 for barrier fluid. This typically consists of gas accumulators in cooperation with liquid accumulators. Barrier pressure to be maintained across the rotating seals, are produced by means of a control valve 27, which in this example uses the pump suction pressure as a reference. This corresponds to the pressure on the lower side of the rotating seal 29.

The control valve 27 compensates for an increase in the reference pressure by delivering fluid from HP liquid supply unit 25. Upon drop in the reference pressure, regulator 28 comes into operation and dumps fluid from the motor chamber to the pump inlet as required. The pressure variations are usually small and represent little loss of barrier fluid.

If the pump stops, the motor chamber must have a supply of fluid. The volume that must be supplied may typically be 25-40 liters. This is taken from the HP liquid supply unit 25, which will later on be compensated for the fluid that has been delivered via an umbilical 26.

When the pump is re-started, the liquid in the engine compartment is quickly heated and expands correspondingly. Hence, a liquid volume, corresponding to what was previously refilled, will be dumped into the pump and thus follow the well flow to the surface. For booster pumps that are operating at great depths, the supply pressure to the control valve 27 can typically be in the range 400 to 1000 bara. Due to low compressibility in highly pressurized gas, the HP liquid supply unit 25 may be of considerable size, especially if one wants to have a certain buffer with respect to volume of liquid that can be supplied.

FIG. 5B illustrates how a system according to the invention can be connected into the barrier system to reuse the barrier liquid. The control valve 28 in the barrier system can now be used as the valve device 11, whilst the liquid to be pulled away from the motor chamber are directed into the storage tank 7 instead of being fed into the well stream. The liquid can then be pumped in a suitable speed back to the HP fluid supply 25 as illustrated in the figure. The storage tank 7 can for this purpose typically of size 50 to 80 liters, which equates to a traditional gas container. It must be designed to withstand absolute vacuum on the relevant depth. Likewise, the pump 9 must be dimensioned to be able to push the fluid back to the HP supply unit against a pressure of approximately 400 to 1000 bar. This is considered easily feasible with a flow rate which may be significantly greater than what is normally obtainable via long umbilical from the surface.

A third important application of the invention is to provide a system for medium and large depths that is suitable to generate driving force for actuators or to provide hydraulic power.

FIG. 6 shows the relevant invention connected to two different actuators. Both actuators are using ambient seawater as reference. The actuator in FIG. 6*a*) is adapted to push, and the actuator of FIG. 6*b*) is adapted to pull. The valve assembly 11 can in this embodiment be a traditional remote operated open/shut-off valve.

In many contexts are hydraulic pressures being used for operation of valves, for establishing locking forces etc. In an application as in FIG. 6, the invention operates like an inverse accumulator, and requires little space. This embodiment is based on actuators that are being returned to their starting position by using the pump 9. A storage chamber and a pump unit could be used to control many actuators. A number of remotely controlled valves are required in order to operate each actuator separately.

The force that can be produced in this manner is illustrated by the following calculation example that is referring to the actuator of FIG. 6*b*.

We assume a piston 31 has a diameter of 15 cm, and the installation is positioned at 400 meters depth. This means that the piston area A=π*7.52=176.7 cm2. When opening the valve assembly 11, the actuator will generate a force corresponding to:

$$F=41\ \text{kp/cm2}*176.7\ \text{cm2}=7\tfrac{1}{4}\ \text{tons.}$$

This is not an unreasonable actuator size, and a force of this size is considered to be ample to operate many types of valves. An offset of for example 50 cm would require a volume of 8.8 liters being occupied by storing tank. If desired, this could be accomplished in a few seconds by appropriate choice of pipe dimensions. For the same actuator sizing, the generated power increases linearly with depth. For example, at 2000 msw, the power that can be generated by a corresponding actuator is;

$$F=201\ \text{kp/cm2}*176.7\ \text{cm2}=35.5\ \text{tons.}$$

If there is a need for quick resetting of the actuators, one may use a setup as shown in FIG. 7. It includes a HP liquid supply unit 25 which serves two functions in that it helps to increase the force actuators generating, and moreover makes it possible for the actuators to work quickly in both directions. This requires that the valve assembly 11 has more functions, and consequently becomes more complicated. In the illustrated embodiment, there are four open/shut-off valves. These are interconnected such that two of the valves are open, while the other two are closed. FIG. 7 shows a constellation with two actuators which are in opposite modes, and has gone to their respective end positions. Because the storage chamber is virtually without pressure, the actuator pistons are affected by a pressure difference corresponding to the absolute pressure in the HP liquid supply unit 25. The dimensioning can be chosen so that the desired effect is being generated. The pump 9 is arranged to pump liquid from the storage tank 7 back directly to the HP liquid supply unit 25.

In certain situations, one needs to have access to hydraulic energy in order to perform necessary operations. Such hydraulic energy can be produced by utilizing the pressure difference between the ambient water pressure and a low pressure, using an actuator in which the piston rod is enlarged and adapted to establish pressure in a liquid filled volume. Such a solution is outlined in FIG. 8 where the required hydraulic pressure is generated in chamber II, inside cylinder 33. Here the upper face of the piston 32 is affected by ambient water pressure, and the liquid stored in compartment II is being pressurized when the chamber III is given open connection to the storage tank 7.

In U.S. Pat. No. 6,202,753 B1 a similarly designed cylinder is used to generate hydraulic pressure energy by correspondingly ensuring that the chamber III is bounded in a state in which pressure is low or possibly vacuum.

The functioning of the patented embodiment and present invention differ in significant respects, which includes.

- in the present invention, unlike the embodiment of that patent, chamber III is filled with liquid at any time. Leakage through the seal must be quite large before an embodiment in accordance with present invention will cease to function;
- the hydraulic pressure is normally not generated by putting the upper side of the piston 32 in contact with the surrounding water, but by opening the valve assembly 11 towards a practically pressure free storage tank 7;
- the present invention makes it possible to reset the hydraulic capacity in one single operation—based on pumping back the liquid that was emitted from chamber III during the generation of hydraulic power.

Otherwise, by employing various embodiments of the invention, one can address the same functions as shown in the above patent, with respect both to generate hydraulic energy and to establish the necessary locking force to for example a "Blow-out preventer".

At large depths, an embodiment outlined in FIG. 8 is able to produce high hydraulic pressure in combination with relatively large flow rate, even with a moderate sizing of the cylinder 33.

At smaller depths, it may be advantageous to connect the cylinder towards a HP liquid supply unit as shown in FIG. 9. In the illustrated embodiment one has adapted a valve body 35 in the piston, whereby the return of fluid to chamber III and to the HP liquid supply unit 25 can be performed in one pumping operation. The liquid from the storage tank 7 pushes piston 32 to its upper position, whereby the valve body 35 is pushed downwards and allows the liquid to be fed into the HP liquid supply unit. Even moderately pressurized liquid that is supplied from the HP liquid supply can generate a significant amount of hydraulic energy, in the form of a fairly large volume of highly pressurized fluid from chamber II.

In this embodiment one can keep the gas accumulators in the HP liquid supply unit at a relatively low pressure level, and thus take advantage of good gas compressibility.

To further exploit the capacity of the aforementioned gas accumulators, a pressure reducer valve 36 can be arranged between the gas reservoirs and the liquid filled accumulators. The outlet pressure from this valve is preferably pre set to equal the lowest pressure level required to generate the desired force.

FIG. 10 shows two embodiments that are adapted to sustain the desired hydraulic pressure resp. desired force via an actuator. This is achieved regardless of the pressure in the gas accumulators—provided it is not dropping below set level of the above mentioned outlet pressure. The gas volume supplied by said valve 36 is equal to the liquid volume that is supplied by the liquid accumulator. Since volume of gas increases after a pressure reduction, this pressure reducer valve allows us to use the accumulated gas substantially more efficiently.

In order to have the HP liquid supply unit recharged and ready for re-activation, the gas must be returned to the gas accumulators. The easiest way to achieve this is to arrange a check valve on the pressure reducer valve. Upon activation of the pump, the pressure downstream of the pressure reducer valve quickly becomes greater than the pressure in gas accumulators. The check valve (not shown in the figure) will then open and allow gas to charge the accumulators.

The invention claimed is:

1. A subsea system for uptake and supply of a liquid from and to at least one mechanical devices, the system comprising:

- a storage tank arranged for being filled with the liquid and having at least one outlet, the at least one outlet being in fluid communication with a lower internal volume of the storage tank,
- a valve assembly being arranged on a feed line,
- a pump having a high-pressure side and a low-pressure side and configured to supply the liquid from the storage tank to the subsea system, and
- a return line being connected to the high-pressure side of the pump,
- the valve assembly, the low-pressure side of the pump and the feed line being in fluid communication with the at least one outlet,
- wherein a closed, liquid-free volume is defined in an upper portion of the storage tank above a liquid volume surface of the storage tank, the feed line is connected to the low-pressure side of the pump and to at least one of the at least one outlet, such that the pump may withdraw liquid from the storage tank when the valve assembly on the feed line is closed, thereby reducing the pressure in the liquid-free volume to a level substantially below ambient liquid pressure,
- the opening of the valve assembly allowing liquid to flow from the at least one mechanical device to the storage tank, wherein the at least one mechanical device is subjected to a pressure difference between ambient water and the liquid-free volume and accordingly starts generating hydraulic power.

2. A system according to claim 1, wherein the at least one outlet is in fluid communication with the lower internal volume of the storage tank via a vertical riser pipe.

3. A system according to claim 1, wherein the at least one outlet is arranged in a lowermost part of the storage tank.

4. A system according to claim 1, wherein the pump comprises an intake on the low-pressure side, and the intake is arranged below the at least one outlet of the storage tank.

5. A system according to claim 1, wherein the pump is a positive displacement pump.

6. A system according to claim 5, wherein the pump comprises at least one reciprocating unit.

7. A system according to claim 1, wherein the low-pressure side of the pump is in fluid communication with the feed line at a point between the storage tank and the valve assembly.

8. A system according to claim 1, wherein the valve assembly is an on/off valve, a back-pressure regulator or any other valve, or combination of valves, suitable for controlling liquid flow through the feed line.

9. A system according to claim 1, wherein the feed line is in fluid contact with the hydraulic fluid of a hydraulic actuator, the fluid barrier of a subsea motor chamber, or in fluid contact with any fluid system requiring, or benefiting from, regulation of the fluid pressure of the fluid system.

10. A system according to claim 1, wherein the return line is in fluid communication with the high-pressure side of the pump.

11. A system according to claim 10, wherein the return line is in fluid communication with the feed line at a point on the feed line situated opposite the valve assembly in relation to the storage tank.

12. The use of a system according to claim 1, for regulating pressure of fluids in a subsea system, the fluids comprising hydraulic fluids, barrier fluids and any oil- or water-based fluids.

13. The use of a system according to claim 12, wherein the subsea system is a production pipe line, a pump, an actuator, an hydraulic pressure booster or a fluid storage tank.

14. The use of a system according to claim 13, wherein the pump is a subsea booster pump.

15. A method for obtaining a subsea system capable of rapid uptake of a liquid, wherein the method comprises:

filling a storage tank, having at least one outlet, with a liquid;

arranging the storage tank with the at least one outlet being in fluid communication with a lower internal volume of the storage tank;

defining a closed, liquid-free volume in an upper portion of the storage tank above a liquid volume surface of the storage tank;

interconnecting the storage tank and an external volume in need of supply of the liquid;

supplying the external volume with liquid by withdrawing at least parts of the liquid from the storage tank by use of a positive displacement pump in fluid contact with the at least one outlet, thereby reducing pressure in the liquid-free volume to a level substantially below ambient liquid pressure; and in case of undesirable pressure rise in the external volume, refilling the storage tank through a feed line by opening a valve assembly arranged on the feed line.

16. A subsea system for uptake and supply of a liquid from and to at least one mechanical device, the system comprising:

a storage tank arranged for being filled with the liquid and having at least one outlet, the at least one outlet being in fluid communication with a lower internal volume of the storage tank, a valve assembly being arranged on a feed line, a pump having a high-pressure side and a low-pressure side, and a return line being connected to the high-pressure side of the pump, the valve assembly, the low-pressure side of the pump and the feed line being in fluid communication with the at least one outlet, wherein a closed, liquid-free volume is defined in an upper portion of the storage tank above a liquid volume surface of the storage tank, the feed line is connected to the low-pressure side of the pump and to at least one of the at least one outlet, such that the pump may withdraw liquid from the storage tank when the valve assembly on the feed line is closed, thereby reducing the pressure in the liquid-free volume to a level substantially below ambient liquid pressure, the opening of the valve assembly allowing liquid to flow from the at least one mechanical device to the storage tank, wherein the at least one mechanical device is subjected to a pressure difference between ambient water and the liquid-free volume and accordingly starts generating hydraulic power, wherein the pump comprises an intake on the low-pressure side, and the intake is arranged below the at least one outlet of the storage tank.

17. A subsea system for uptake and supply of a liquid from and to at least one mechanical device, the system comprising:

a storage tank arranged for being filled with the liquid and having at least one outlet, the at least one outlet being in fluid communication with a lower internal volume of the storage tank, a valve assembly being arranged on a feed line, a pump having a high-pressure side and a low-pressure, and a return line being connected to the high-pressure side of the pump, the valve assembly, the low-pressure side of the pump and the feed line being in fluid communication with the at least one outlet, wherein a closed, liquid-free volume is defined in an upper portion of the storage tank above a liquid volume surface of the storage tank, the feed line is connected to the low-pressure side of the pump and to at least one of the at least one outlet, such that the pump may withdraw liquid from the storage tank when the valve assembly on the feed line is closed, thereby reducing the pressure in the liquid-free volume to a level substantially below ambient liquid pressure, the opening of the valve assembly allowing liquid to flow from the at least one mechanical device to the storage tank, wherein the at least one mechanical device is subjected to a pressure difference between ambient water and the liquid-free volume and accordingly starts generating hydraulic power, and wherein the return line is in fluid communication with the feed line at a point on the line situated opposite the valve assembly in relation to the storage tank.

* * * * *